United States Patent [19]

Barclay et al.

[11] 4,451,266

[45] May 29, 1984

[54] ADDITIVE FOR IMPROVING PERFORMANCE OF LIQUID HYDROCARBON FUELS

[75] Inventors: John D. Barclay, 98 Birchcliffe Ave., Kitchener, Ontario, Canada, N2M4V6; Rawson B. Harmon, Jr., 4001 Long Valley Rd., Santa Ynez, Calif. 93460

[73] Assignees: John D. Barclay; Rawson B. Harmon, Jr.; John N. McIntosh, all of Los Angeles, Calif.

[21] Appl. No.: 341,705

[22] Filed: Jan. 22, 1982

[51] Int. Cl.[3] ..... C10L 1/18

[52] U.S. Cl. ..... 44/53; 44/56; 44/57; 44/66

[58] Field of Search ..... 44/53, 56, 57, 66

[56] References Cited

U.S. PATENT DOCUMENTS

| | | | |
|---|---|---|---|
| 1,296,902 | 3/1919 | Backhaus | 44/56 |
| 1,313,158 | 8/1919 | Backhaus | 44/56 |
| 1,420,007 | 6/1922 | Whitaker | 44/53 |
| 1,682,561 | 8/1928 | Hennen | 44/66 |
| 2,662,817 | 12/1953 | Russell et al. | 44/53 |
| 3,563,715 | 2/1971 | Richardson et al. | 44/66 |
| 4,231,756 | 11/1980 | King | 44/56 |
| 4,286,969 | 9/1981 | Medcalf | 44/56 |
| 4,294,586 | 10/1981 | Cox, Jr. | 44/56 |

*Primary Examiner*—Charles F. Warren
*Assistant Examiner*—Margaret B. Medley
*Attorney, Agent, or Firm*—Lyon & Lyon

[57] ABSTRACT

Described herein is an additive to hydrocarbon fuels such as gasoline, diesel fuel and the like used, for example, in vehicles and furnaces. The fuel comprises a mixutre of a low molecular weight alcohol, an aliphatic ester, an aromatic hydrocarbon, a halogenated alkene, a hydroxy unsaturated vegetable oil and an aliphatic hydrocarbon. Use of the additive improves fuel efficiency and provides cleaner burning, i.e., reduces engine deposits.

10 Claims, No Drawings

ADDITIVE FOR IMPROVING PERFORMANCE OF LIQUID HYDROCARBON FUELS

FIELD OF THE INVENTION

This invention relates to additives for liquid hydrocarbon fuels such as gasoline and diesel fuel to obtain improved fuel efficiency and cleaner combustion.

BACKGROUND

The last 100 years of industrial progress largely has been possible because of the relative abundance and convenience of using liquid hydrocarbon fuels as an energy source. Notwithstanding current efforts to conserve petroleum resources and to use alternative energy sources such as coal, nuclear, solar, geothermal, and the like, fuel obtained from oil remains our main energy source for everything from vehicles and home heating plants to our largest industrial facilities.

Our dependence upon liquid hydrocarbon fuels has not been an unalloyed blessing, however. As its use has increased, oil-based fuel has been the source of much industrial and urban pollution. Furthermore, though once very abundant and inexpensive, oil has recently become a very expensive commodity and, since it is a non-renewable resource, oil will become scarce in the future. However, our use of it is so universal that even the most optimistic predictions of achieving transition to alternatives forecast many years of high consumption.

Accordingly, efforts have been directed to improving the performance of machinery using liquid hydrocarbon fuels, for example, by increasing the miles per gallon of automobiles. In part this has involved redesign of the machinery which uses the fuel. However, another tactic has been to change the combustion characteristics of the fuel itself by refining and by the use of additives. With regard to the latter, the use of alkyl lead components to increase the octane rating of fuel is perhaps the best example. However, since lead compounds are an environmental hazard themselves, their use is being phased out. Various other fuel supplements intended to improve performance are described, for example, in King, U.S. Pat. No. 4,231,756; Richardson et al, U.S. Pat. No. 3,563,715; Russell et al, U.S. Pat. No. 2,662,817; Hennen, U.S. Pat. Nos. 1,923,048 and 1,682,561; and Backhaus, U.S. Pat. No. 1,313,158.

Although there have been substantial efforts made to improve hydrocarbon fuels by supplementing them with various additives, these efforts have not enjoyed widespread acceptance or much success because of one shortcoming or another. Accordingly, there has long been, and still remains, a need for an inexpensive yet effective additive for liquid hydrocarbon fuels to improve efficiency and provide cleaner combustion in order to stretch supplies of this critical resource and reduce costs.

SUMMARY OF THE INVENTION

The present invention provides an improved additive for combining with liquid hydrocarbon fuels such as gasoline and diesel oil to improve fuel efficiency and to provide cleaner combustion. The additive comprises, on a volume/volume basis, a mixture of a low molecular weight alcohol (3–10%); an aliphatic ester (5–15%); an aromatic hydrocarbon (3–13%); a halogenated alkene (3–13%); an hydrocarbon with a 50% boiling point between 240° F. (115° C.) and 360° F. (182° C.) (35–70%); and a hydroxy unsaturated vegetable oil (20–30%). When added to a liquid hydrocarbon fuel such as gasoline or diesel fuel, the fuel performs with greater efficiency and burns more cleanly.

Accordingly, an object of the present invention is an improved liquid hydrocarbon fuel that performs more efficiently and has improved combustion characteristics.

Another object of the present invention is to provide a fuel for vehicles which provides an increase in miles/gallon and reduces engine deposits.

Another object of the present invention is to provide a fuel for heating and power plants that burns more cleanly and increases the heat output of the fuel.

DETAILED DESCRIPTION

As pointed out above, the present invention is an additive for liquid hydrocarbon fuels comprising a mixture of ingredients. One ingredient is a low molecular weight alcohol, i.e., an alcohol having four or fewer carbon atoms. Among such alcohols may be mentioned methanol, ethanol, propanol, isoproponol, butanol and the like. The alcohol will comprise, on a volume/volume basis 3–10% of the mixture. Methanol is presently preferred. Mixtures of alcohols may be used.

A second ingredient is an aliphatic ester. Suitable esters have 6 or fewer carbon atoms and include, without limitation, methyl acetate, ethyl acetate, propyl acetate, t-butyl acetate, methyl propionate, ethyl propionate, methyl n-butyrate, isopropyl acetate, methyl isobutyrate, and mixtures thereof. The ester comprises 5–15% of the additive. Acetates, and, particularly, propyl acetate are preferred.

A third ingredient of the additive is an aromatic hydrocarbon. Suitable ones include without limitation, benzene toluene, o-, m-, and p-xylene, naphthalene, bisphenyl and the like, including mixtures thereof. The aromatic hydrocarbon comprises 3–13% of the mixture and toluene is presently preferred.

A fourth ingredient is a halogenated alkene. Chloro-, bromo and mixed chlorobromo alkenes are preferred. The alkene chain will generally have 3 or fewer carbon atoms and suitable haloalkenes include tetrachloroethylene, tetrabromoethylene, dibromodichloroethylene and trichloroethylene and mixtures thereof. The haloalkene comprises 3–13% of the additive. Tetrachloroethylene is preferred.

The hydrocarbon, which comprises 35–70% of the additive, is conveniently a hydrocarbon fraction with a 50% boiling point between 240° F. (115° C.) and 360° F. (182° C.). Low boiling kerosene (b.p. 160° C.) is a presently preferred material.

The last ingredient is a hydroxy substituted unsaturated acid which comprises 20–30% of the additive. Vegetable oils which comprise such an acid are a suitable source. Castor oil, which is principally ricinoleic acid, is a preferred oil. However, other hydroxylated, unsaturated acids of 16–24 carbon atoms are also suited.

A sufficient quantity of the additive is added to the fuel to improve the efficiency with which the fuel burns or operates in an engine or other operating characteristics. The amount which will give optimum results can vary depending upon the kind and quality of the fuel, engine or burner design and the like. However, use of as little as 1 part additive to 2500 parts fuel, on a volume to volume basis, will show improved results. Generally best results are achieved in the range from about 1/2000 to 1/500 parts additive to fuel with the range 1/2000 to 1/1000 being preferred.

A presently preferred composition for use in the invention has the following composition (% v/v):

Methanol: 5.0
Propyl acetate: 8.0
Toluene: 6.0
Tetrachloroethylene: 6.0
Hydrocarbon (50% b.p. 160° C.): 50
Castor: 25

EXAMPLE 1

Additive of the specific additive described above to commercial premium gasoline (Octane number=89) in an approximate ratio of 1 part additive to 1000 parts fuel, on a volume/volume basis (2.5 ozs to 20 gallons) gave the following results:

(a) color and specific gravity remained unchanged;

(b) distillation range has slight change in the end point which is considered insignificant insofar as evaporation rate is concerned;

(c) the gum content of the fuel increased slightly but remained within specifications for automobile carburetor requirements;

(d) corrosion rating was unaffected as no adverse affects on copper or copper alloy from which fuel system components are fashioned; and (e) fuel octane rating increased 0.6 units in engine tests from 89 to 89.6.

The foregoing results demonstrate the benefit of addition of the additive of the present invention to gasoline. Higher octane number is associated with improved performance and fuel efficiency in modern engines in that knocking and other adverse effects are reduced which results in cleaner burning within the engine resulting in longer engine life and better mileage.

EXAMPLE 2

Addition of the same additive to commercial bunker fuel, i.e., 1 part additive to 2,000 parts fuel, gave the following results:

(1) Total ash content was reduced by 33%. This is indicative of improved performance as a bunker fuel insofar as plugging or deposit formation is concerned and that high temperature corrosion would be reduced.

(2) The carbon residue was reduced by 7.5%. This is indicative that the formation of carbon deposits in vaporizers, pressure jets and steam atomizing type burners when optimum fuel to air ratios are not maintained will be reduced.

(3) Sulfur content in the ash is reduced 10%. This is indicative also of cleaner burning and underscores a particular advantage of the present invention since sulfur containing deposits on external surfaces of superheater tubes, economizers, air heaters and other boiler parts are reduced. Sulfur is a particularly corrosive ingredient in ash and deposits and reduction of sulfur in deposits will increase the life of parts and their thermal efficiency.

Having fully described our invention, it is to be understood that we are not to be limited to the details described herein but that our invention is of the full scope of the appended claims.

We claim:

1. An additive composition to be added to liquid hydrocarbon fuels in a range from about 1/2000 to about 1/500 parts additive to fuel, consisting essentially of, on a volume/volume basis:

(a) 3–10% of an alcohol of not more than 4 carbon atoms;

(b) 5–15% of an aliphatic ester not more than 6 carbon atoms;

(c) 3–13% of an aromatic hydrocarbon;

(d) 3–13% of a halogenated alkene;

(e) 35–70% of a hydrocarbon with a 50% boiling point between 115° C. and 182° C.; and (f) 20–30% of a hydroxy substituted, unsaturated acid.

2. A composition according to claim 1 wherein the alcohol is selected from methanol, ethanol, propanol, isopropanol, butanol and mixtures thereof; the aliphatic ester is selected from methyl acetate, ethyl acetate, propyl acetate, t-butyl acetate, methyl propionate, ethyl propionate, methyl-n-butyrate, isopropyl acetate, methyl isobutyrate and mixtures thereof; the aromatic hydrocarbon is selected from benezene, toluene, o-xylene, m-xylene, p-xylene, napthalene, biphenyl and mixtures thereof; and the halogenated alkene is selected from chloroalkenes, bromoalkenes, and chlorobromoalkenes; and the unsaturated acid is an acid of 16–24 carbon atoms.

3. A composition according to claim 2 wherein the halogenated alkene is selected from tetrachloroethylene, tetrabromoethylene, dibromodichloroethylene, trichloroethylene and mixtures thereof.

4. A composition according to claims 1, 2 or 3 wherein the unsaturated acid is ricinoleic acid.

5. A composition according to claims 1, 2 or 3 wherein the source of the acid is a vegetable oil.

6. A composition according to claim 5 wherein the oil is Castor oil.

7. A composition according to claims 1, 2 or 3 wherein the hydrocarbon is low boiling kerosene having a 50% boiling point of 160° C.

8. A composition according to claim 4 wherein the hydrocarbon is low boiling kerosene having a 50% boiling point of 160° C.

9. A composition according to claim 5 wherein the hydrocarbon is low boiling kerosene having a 50% boiling point of 160° C.

10. A composition according to claim 1 comprising 5% methanol, 8% propyl acetate, 6% toluene, 6% tetrachloroethylene, 50% of kerosene having a 50% b.p. of 160° C. and 25% Castor oil.

* * * * *